US010563883B2

(12) United States Patent
Davis, II et al.

(10) Patent No.: US 10,563,883 B2
(45) Date of Patent: Feb. 18, 2020

(54) HVAC BYPASS CONTROL

(71) Applicant: Lennox Industries Inc., Richardson, TX (US)

(72) Inventors: Walter Davis, II, Dallas, TX (US); Roger Hundt, Carrollton, TX (US); Colin Clara, Frisco, TX (US); Eric Perez, Hickory Creek, TX (US)

(73) Assignee: Lennox Industries Inc., Richardson, TX (US)

( * ) Notice: Subject to any disclaimer, the term of this patent is extended or adjusted under 35 U.S.C. 154(b) by 11 days.

(21) Appl. No.: 15/879,140

(22) Filed: Jan. 24, 2018

(65) Prior Publication Data

US 2019/0226709 A1 Jul. 25, 2019

(51) Int. Cl.

| | |
|---|---|
| ***F24F 11/00*** | (2018.01) |
| ***F24F 11/49*** | (2018.01) |
| ***F24F 11/63*** | (2018.01) |
| ***F24F 11/65*** | (2018.01) |
| ***F25B 49/02*** | (2006.01) |
| *F24F 140/50* | (2018.01) |
| *F24F 110/10* | (2018.01) |
| *F24F 140/12* | (2018.01) |

(52) U.S. Cl.

CPC ..... *F24F 11/49* (2018.01); *F24F 11/63* (2018.01); *F24F 11/65* (2018.01); *F25B 49/022* (2013.01); *F24F 2110/10* (2018.01); *F24F 2140/12* (2018.01); *F24F 2140/50* (2018.01); *F25B 2600/01* (2013.01); *F25B 2600/23* (2013.01); *F25B 2700/05* (2013.01)

(58) Field of Classification Search

None

See application file for complete search history.

(56) References Cited

U.S. PATENT DOCUMENTS

| | | | | |
|---|---|---|---|---|
| 2005/0223725 | A1* | 10/2005 | Crane | F25B 49/02 62/183 |
| 2009/0324428 | A1* | 12/2009 | Tolbert, Jr. | F04B 39/0207 417/44.1 |
| 2018/0135899 | A1* | 5/2018 | Turner | F25B 6/02 |

* cited by examiner

*Primary Examiner* — Paul B Yanchus, III

(74) *Attorney, Agent, or Firm* — Baker Botts L.L.P.

(57) ABSTRACT

A heating, ventilation, and air conditioning (HVAC) system is configured to receive a signal from a thermostat. The signal instructs the HVAC system to operate a component in a partial load mode. The HVAC system is further configured to determine that the component has exceeded its operating envelope. In response to determining that the component has exceeded its operating envelope, the HVAC system is configured to operate the component according to an override configuration. The override configuration overrides the signal to operate the component in the partial load mode.

20 Claims, 6 Drawing Sheets

HVAC BYPASS CONTROL

TECHNICAL FIELD

Certain embodiments of this disclosure relate generally to an HVAC system with one or more controllable components, and more specifically, to bypassing signals to the HVAC system to ensure optimal operation of the one or more controllable components.

BACKGROUND

A heating, ventilation, and air conditioning (HVAC) system may include one or more controllable components that may operate in different stages or at different levels of operation. The components, or controllers thereof, may receive signals that indicate to the component to operate at one of the levels. These signals may be generated based on the HVAC needs of a space or location, such as cooling based on a temperature measurement at the space and a predetermined set point. One example of a component of an HVAC system is a compressor, such as a two-speed compressor, that may operate in a full load operation or a partial load operation. The operation of the compressor may be controlled by signals from a thermostat or another controller. In some circumstances, the signals may indicate to the compressor to operate in a partial load operation, which has a corresponding partial load envelope indicating stable operating parameters of the compressor in partial load operation. If the compressor operates outside the partial load envelope during partial load operation, the compressor may be unable to operate as intended, which may result in damage to the compressor or other components of the HVAC system.

SUMMARY OF THE DISCLOSURE

According to one embodiment, a heating, ventilation, and air conditioning (HVAC) system is configured to receive a signal from a thermostat. The signal instructs the HVAC system to operate a component in a partial load mode. The HVAC system is further configured to determine that the component has exceeded its operating envelope. In response to determining that the component has exceeded its operating envelope, the HVAC system is configured to operate the component according to an override configuration. The override configuration overrides the signal to operate the component in the partial load mode.

In particular embodiments, the HVAC system is further configured to determine a present setpoint of the thermostat. The HVAC system is further configured to operate the component in a full load mode until the present setpoint is reached. The HVAC system is further configured to turn off the component for a period of time once the present setpoint has been reached.

In particular embodiments, the HVAC system is further configured to determine that the component has resumed operating within its operating envelope for a pre-determined time period. In response, the HVAC system releases the override configuration such that the HVAC system resumes operating according to signals received from the thermostat. The pre-determined time period is determined based on a timer that resets each time the HVAC system receives an indication that the component has exceeded its operating envelope.

In particular embodiments, the HVAC system, when operating according to the override configuration, is further operable to allow signals from the thermostat that instruct the HVAC system to operate the component in full load mode or off mode.

In particular embodiments, the component corresponds to a compressor of the HVAC system. To determine that the compressor has exceeded its operating envelope, the HVAC system is further configured to determine whether at least one of the following values has exceeded a threshold: suction pressure, discharge pressure, pressure differential, suction temperature, discharge temperature, temperature differential, compressor force, compressor torque, compressor vibration, compressor current, a combination of any of the preceding.

In particular embodiments, the threshold is determined based on a self-learning algorithm that adjusts the threshold based on monitoring performance of the component over time.

In particular embodiments, the operating envelope of the component is determined based on the model of the component.

According to another embodiment, a method of operating a HVAC system includes receiving a signal from a thermostat. The signal instructs the HVAC system to operate a component in a partial load mode. The method further includes determining that the component has exceeded its operating envelope. In response to determining that the component has exceeded its operating envelope, the method further includes operating the component according to an override configuration. The override configuration overrides the signal to operate the component in the partial load mode.

In particular embodiments, the method of operating the HVAC system further includes determining a present setpoint of the thermostat. The method further includes operating the component in a full load mode until the present setpoint is reached. The method further includes turning off the component for a period of time once the present setpoint has been reached.

In particular embodiments, the method of operating the HVAC system further includes determining that the component has resumed operating within its operating envelope for a pre-determined time period. In response, the method further includes releasing the override configuration such that the HVAC system resumes operating according to signals received from the thermostat. The pre-determined time period is determined based on a timer that resets each time the HVAC system receives an indication that the component has exceeded its operating envelope.

In particular embodiments, operating according to the override configuration includes allowing signals from the thermostat that instruct the HVAC system to operate the component in full load mode or off mode.

In particular embodiments, the component corresponds to a compressor of the HVAC system. To determine that the compressor has exceeded its operating envelope, the method further comprises determining whether at least one of the following values has exceeded a threshold: suction pressure, discharge pressure, pressure differential, suction temperature, discharge temperature, temperature differential, compressor force, compressor torque, compressor vibration, compressor current, a combination of any of the preceding.

In particular embodiments, the threshold is determined based on a self-learning algorithm that adjusts the threshold based on monitoring performance of the component over time.

In particular embodiments, the operating envelope of the component is determined based on the model of the component.

According to yet another embodiment, a system includes a compressor, a controller, and a bypass circuit. The compressor receives a first signal and a second signal. The first signal indicates to the compressor to turn on or off. The second signal indicates to the compressor at which speed to operate. The controller controls the operation of the compressor. The first and second signals originate from signals generated at the controller. The bypass circuit overrides the second signal originating from signals generated at the controller. The bypass circuit further supplies a replacement second signal to the compressor.

In particular embodiments, the bypass circuit is configured to override the second signal comprises overriding a signal to the compressor to run in a partial load mode. The bypass circuit is further configured to supply a replacement signal comprising supplying a signal to the compressor to run at a full load mode.

In particular embodiments, the bypass circuit is configured to override the second signal comprises overriding a signal to the compressor to run in a full load mode. The bypass circuit is further configured to supply a replacement second signal comprising supplying a signal to the compressor to run at a partial load mode.

In particular embodiments, the system includes one or more sensors comprising one or more of a temperature sensor, a pressure sensor, a pair of temperature sensors, or a pair of pressure sensors. The bypass circuit is configured to override the second signal and supply the replacement signal based on measurements at the one or more sensors. In some embodiments, the bypass circuit is further configured to compare a measurement from the one or more sensors to a threshold. The bypass circuit is further configured to determine whether to override the second signal and supply a replacement signal based on the comparison of the measurement to the threshold.

In particular embodiments, the system further includes one or more sensors comprising one or more of a vibration sensor and a current sensor. The bypass circuit is configured to override the second signal and supply the replacement signal based on measurements at the one or more sensors. In some embodiments, the bypass circuit is further configured to compare a measurement from the one or more sensors to a threshold. The bypass circuit is further configured to determine whether to override the second signal and supply a replacement signal based on the comparison of the measurement to the threshold.

In particular embodiments, the bypass circuit is configured to override the second signal and supply the replacement second signal to the compressor for a predetermined period of time.

In particular embodiments, the bypass circuit is further configured to prevent the compressor from operating outside an operation envelope based on a current mode of operation of the compressor.

Certain embodiments may provide one or more technical advantages. For example, certain embodiments may reduce inefficiencies and/or prevent damage that may otherwise occur if a component were to operate outside of its envelope. As another example, in certain embodiments, an HVAC system may use a present setpoint of the thermostat and operate the component in a full load mode until the present setpoint is reached. In this manner, the HVAC system may still provide the desired environment based on the already set setpoint, while overriding the partial load mode when the component has exceeded its operating envelope. As another example, in certain embodiments, the HVAC may release the override configuration after determining that the component has resumed operating within its operating envelope for a pre-determined time period. In this manner, the system may avoid releasing and retriggering the override configuration unnecessarily. As yet another example, the system may include one or more sensors from which the system may receive measurements of temperature, pressure, vibration, or current. The measurements may be used to determine whether to override the component by comparing the measurements to a threshold.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
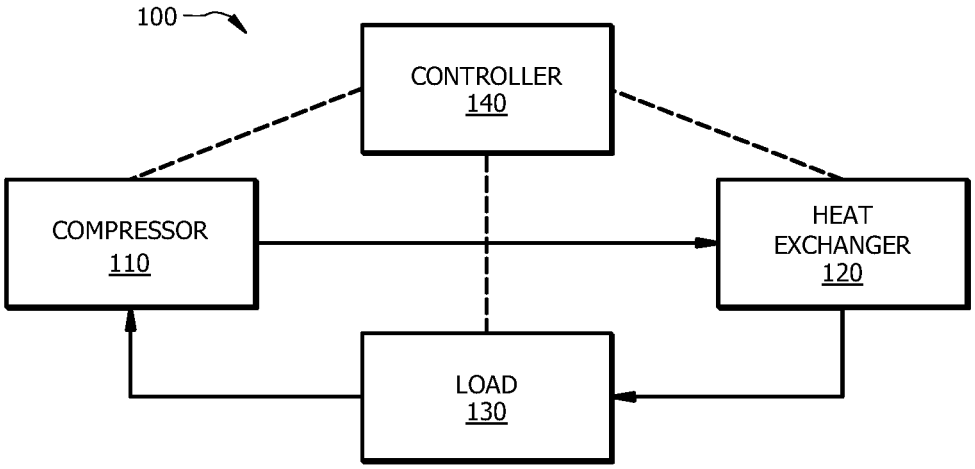
FIG. 1 illustrates an example HVAC system, according to certain embodiments.

Embodiments of the present disclosure and its advantages are best understood by referring to FIGS. 1 through 7 of the drawings, like numerals being used for like and corresponding parts of the various drawings.

HVAC systems may include one or more controllable components that may operate at one or more operating levels, such as in a partial load operation or a full load operation. For example, based on the desired environment of a space, a controller, such as a thermostat, may control a component to turn on or off and at what level the component should operate. In some conditions, the controller may send signals that indicate to the component to operate in a partial load operation. This partial load operation may be more energy efficient due to the operation of the component in a different manner than in a full load operation. This may be desirable when the environmental conditions of a space that the HVAC system covers are close to the optimal conditions, e.g. the temperature of the space is near a temperature setpoint. In this manner, components, such as a compressor of the HVAC system, may be run in only a partial load operation to save energy while still supplying sufficient compression to meet the demands of the space.

In conventional systems, the operation of the component in a partial load or full load operation is determined by a controller, such as a thermostat, based only on the desired environmental conditions of the space. This conventional operation does not, however, account for situations where the component may be controlled to operate in a partial load operation, but based on the conditions, operates outside its partial load operating envelope. In such cases, the component may operate unstably, potentially causing damage to the component and degrading the HVAC system's performance over time. Thus, even with full control of the operation state of the component, conventional HVAC systems may cause the component to operate outside its operating envelope.

The disclosure herein describe systems and methods that address the above problem by providing bypass mechanisms that override the current operating state of the component to avoid operating the component outside its operating envelope. In this manner, damage to components may be avoided without reducing the performance of the HVAC system. Certain embodiments may provide one or more technical advantages. For example, the HVAC system may, in certain embodiments, use a present setpoint of the thermostat and operate the component in a full load mode until the present setpoint is reached. In this manner, the HVAC system may still provide the desired environment based on the already set setpoint, while still overriding the partial load mode when the component has exceeded its operating envelope. As another example, in certain embodiments, the HVAC may also release the override configuration after determining that the component has resumed operating within its operating envelope for a pre-determined time period. In this manner, the system may avoid releasing and retriggering the override configuration unnecessarily. As yet another example, the system may include one or more sensors from which the system may receive measurements of temperature, pressure, vibration, or current. The measurements may be used to determine whether to override the component by comparing the measurements to a threshold.

Certain embodiments may include none, some, or all of the above technical advantages. One or more other technical advantages may be readily apparent to one skilled in the art from the figures, descriptions, and claims included herein.

FIG. 1 illustrates an example generalized HVAC system 100, according to certain embodiments. HVAC system 100 may include a compressor 110, a heat exchanger 120, a load 130, and a controller 140. In this particular example, HVAC system 100 may be configured to cool a space proximate to load 130 by flowing refrigerant through compressor 110, heat exchanger 120, and a load 130. For example, refrigerant may flow from load 130 to compressor 110. Compressor 110 may be configured to increase the pressure of the refrigerant. As a result, the heat in the refrigerant may become concentrated and the refrigerant may become a high pressure gas. Compressor 110 may send the compressed refrigerant to heat exchanger 120. Heat exchanger 120 may transfer heat from the refrigerant to another media, e.g., another refrigerant or the ambient environment proximate heat exchanger 120. In some embodiments, heat exchanger 120 may be an evaporator or a condenser. After removing heat from the refrigerant, heat exchanger 120 may send the refrigerant back to load 130. Load 130 may use the refrigerant to remove heat from a space, or conversely to transfer heat to the refrigerant. For example, load 130 may include a heat exchanger separate from heat exchanger 120 that exchanges heat from the space to the refrigerant, or vice-versa. The refrigerant may be discharged from load 130 back to compressor 110 so that it may be compressed again.

The above example HVAC system 100 is described above as using a refrigerant to cool a space, the disclosure herein applies to any HVAC system having one or more controllable components operable in more than one operational states (e.g., full load plus one or more partial load operational states). Thus, while the example of compressor 110 may be used throughout, as illustrated in connection with FIGS. 2 through 7, to describe one or more embodiments, the methods and apparatuses disclosed herein may be equally applicable to a variety of controllable components in a wide range of HVAC systems and/or refrigeration systems.

In certain embodiments, HVAC system 100 may further include a controller 140. Controller 140 may be communicatively coupled to one or more components of HVAC system 100, such as compressor 110, heat exchanger 120, and load 130. In this manner, controller 140 may be configured to receive and/or send signals to one or more of the components of HVAC system 100. As discussed above, in some embodiments, HVAC system 100 includes one or more controllable components. Accordingly, controller 140 may send one or more signals to the components of HVAC system 100 to control the operation of those components. For example, controller 140 may send a signal to compressor 110 to turn it on or off. As another example, controller 140 may send a second signal to compressor to switch between a first operating mode or a second operating mode. Similarly, controller 140 may control one or more other components of HVAC system 100, including additional components not explicitly illustrated.

The signals sent by controller 140 may be generated based on the current environment of a space or area located proximate to load 130. In certain embodiments, controller 140 may be limited to receiving signals that are based on comparisons of the current environment of the space and predetermined or preset setpoints or thresholds. For example, controller may send a single for compressor 110 to turn on when the temperature of the space proximate to load 130 exceeds a certain threshold temperature. Compressor 110 may then turn on and begin compressing refrigerant to that may be used at load 130 to cool the space. In some embodiments, controller 140 may send a signal to operate in one or more operation states or modes. For example, if the temperature of the space exceeds the target temperature by several degrees, controller 140 may signal to compressor 110 to turn on and further signal to compressor 110 to operate at full load operation. Once the temperature of the space nears the target temperature (e.g., within one degree of the target temperature), controller 140 may then signal to compressor to operate only in a partial load operation to conserve energy. In this manner, controller 140 may signal compressor 110 based on environmental conditions of the space proximate to load 130 or in response to other external signals, but does not signal compressor 110, or any other components of HVAC system 100, based on the operation characteristics of compressor 110 or the individual component of HVAC system 100. In conventional systems, this may lead to a controllable component of HVAC system 100, such as compressor 110, operating in a condition that may damage the component or otherwise degrade the performance of HVAC system 100.

Controller 140 has been described above as a single controller, but controller 140 may include one or more controller systems. For example, controller 140 may include separate controller systems responsible for various components or operations of HVAC system. For example, portions of controller 140 may reside within one or more components of HVAC system 100 or may be remote to those components of HVAC system 100. Further, in certain embodiments, controller 140 may be used in conjunction with other controlling mechanisms coupled to HVAC system 100. For example, a thermostat measuring the environmental conditions within a space proximate to load 130 may be coupled to controller 140. The thermostat may indicate to controller 140 certain desired operation of components of HVAC system 100, present conditions of the environment in the space, or direct control signals to be relayed to components of HVAC system 100. In this manner, controller 140, as described and used in the present disclosure, is not limited to the simplified example of a centralized controller coupled to every component of HVAC system 100. While it may be described as such in this disclosure, the methods, apparatuses, and systems herein may encompass a variety of control schemes.

As described above, conventional HVAC systems, such as HVAC system 100, may have one or more controllable components, such as compressor 110, which may be controlled, such as by controller 140. The conventional control scheme does not take into account the operational characteristics of the controllable components when controlling their operational states, which may harm the controllable components under certain conditions. Disclosed herein are systems and methods that obviate the above-described problems by overriding and/or bypassing signals that control the operational states of controllable components based on the operational characteristics of the controllable components. Example embodiments of an improved control of HVAC systems are described herein with reference to FIGS. 2 through 7.

Figure 2:
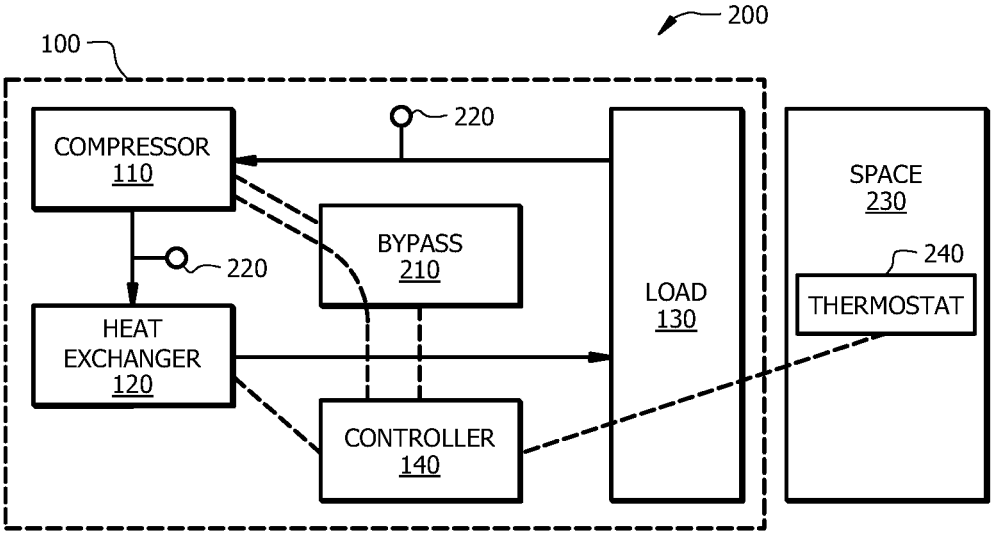
FIG. 2 illustrate an example HVAC system with a bypass, according to certain embodiments.

FIG. 2 illustrate an example HVAC system 200 with a bypass 210, according to certain embodiments. HVAC system 200 may include similar components as HVAC system 100, such as compressor 110, heat exchanger 120, load 130, and controller 140.

Load 130 of HVAC system 200 may be located proximate to space 230. Thermostat 240 may be located within space 230 or may be coupled to one or more sensors in space 230 such that thermostat 240 may measure or receive measurements representing the environmental conditions within space 230. For example, thermostat 240 may determine information that indicates the temperature, the humidity, the time of day, the environmental conditions outside of space 230, etc. Thermostat 240 may further be programmable to send signals based on certain thresholds. For example, thermostat 240 may be programmed with one or more set points, which based on a comparison with the set points and the environmental conditions of space 230, may determine whether environmental control of space 230 is needed. For example, thermostat 240 may compare the temperature of space 230 to a programmed set point and determine the current temperature within space 230 exceeds this set point. Thermostat 240 may then determine that cooling of space 230 is needed. Thermostat 240 may send one or more signals to controller 140, indicating the need for environmental control. Controller 140 may operate as discussed above in reference to FIG. 1 to control one or more components of HVAC system 200.

In certain embodiments, the signaling from thermostat 240 and/or controller 140 may signal compressor 110 to operate in a partial load operation or a full load operation. As the names indicate, partial load operation may include operating compressor 110 at less than 100% of its capacity or at a reduced capacity compared with a full operation. This may be done to conserve energy and/or increase the longevity of compressor 110. Full load operation may refer to compressor 110 operating at its full or normal capacity. Each operation state of compressor 110, and likewise for other controllable components of HVAC system 200, includes an operational envelope. The operational envelope may indicate the stable or unstable operating space of the controllable component. As discussed in further detail in reference to FIG. 3, the operational envelope may be a bounded area or volume of one or more parameters. For example, compressor 110's operational envelope for certain operational modes may be based on the condensing and evaporating temperatures of the refrigerant when compressed by compressor 110. Operating outside these operating envelopes may cause the controllable components to operate in an unstable condition, thereby increasing the risk of damage and degradation of HVAC system 200's performance.

In certain embodiments, HVAC system 200 may further include bypass 210. Bypass 210 may be any suitable hardware and/or software that is configured to receive signals from controller 140 that indicate to one or more of the controllable components of HVAC system 220 to operate in a particular operational state. For example, bypass 210 may be positioned on one or more signal lines between compressor 110 and controller 140. In some embodiments, controller 140 may signal compressor 110 to operate in partial load mode or in a full load mode. Bypass 210 may receive the partial load mode or full load mode signal before it reaches compressor 110. In this manner, bypass 210 may intercept the operational state signaling before it reaches one or more controllable components of HVAC system 200.

In certain embodiments, bypass 210 may receive a signal from a thermostat, such as thermostat 240, which instructs HVAC system 200 to operate a component to operate in a partial load mode. For example, thermostat 240 may send a signal to controller 140 to operate compressor 110 in a partial load mode. Bypass 210 may receive that partial load mode signal.

In certain embodiments, bypass 210 may be configured to determine that the component instructed to operate in a partial load mode has exceeded its operating envelope. For example, bypass 210 may obtain information about the operational characteristics of compressor 210 operating in partial load mode. Based on this information, bypass 210 may determine that compressor 110 is currently, is close to, or may eventually, exceed its partial load operating envelope. As discussed above, operating outside the operating envelope may damage the component or degrade the performance of HVAC system 200.

In certain embodiments, bypass 210 may obtain information about the operational characteristics of controllable components of HVAC system 200 via one or more sensors coupled to HVAC system 200. For example, as depicted in the example in FIG. 2, HVAC system may include sensors 220 coupled to portions of HVAC system 200. Sensors 220 may obtain information about the operating characteristics of one or more components of HVAC system 200. Sensors 220 may be communicatively coupled to one or more of controller 140 and bypass 210. In this manner, bypass 210 may obtain information on which to base its determination of whether a controllable component of HVAC system 200 is exceeding its operational envelope.

In certain embodiments, when bypass 210 determines that the component has exceeded its operating envelope, HVAC system 200 may operate the component according to an override configuration. For example, if bypass 210 determines that compressor 110 is exceeding its partial load envelope, bypass 210 may trigger an override configuration. This may be done directly by bypass 210, wherein bypass 210 sends a replacement signal to the controllable component that overrides the partial load signal from controller 140 and/or thermostat 240, or may be done indirectly, e.g., bypass 210 may provide an indication to controller 140, which then changes its signaling to override its partial load mode signaling. In this manner, bypass 210 may change the operational state of the controllable component from a partial load mode to a full load mode. In most cases, the full load mode operating envelope includes a larger operating space than the partial load mode. As a result, overriding the partial load signal may enable the controllable component to operate in a stable operating space.

In certain embodiments, HVAC system 200 may be configured to determine a present setpoint of thermostat 240. For example, HVAC system 200 may receive from thermostat 240 one or more setpoints, such as temperature setpoints. Using these set points, HVAC system 200 may operate the controllable component, such as compressor 110, in a full load mode until the setpoint is reached. For example, bypass 210 may continue to operate the component in a full load mode/override the signaling for compressor 110 to operate in a partial load mode until the setpoint is reached. HVAC system 200 may turn off the component after the setpoint has been reached. In this manner, the override configuration may allow the setpoint to be reached. In the example of the override configuration operating the component in a full load mode instead of a partial load mode, the setpoint may be reached more quickly at the cost of additional energy resources. Although the override configuration may result in additional energy consumption, it still provides the benefit of avoiding operation of the controllable component of HVAC system 200 outside of its stable operating space, e.g., its operating envelope.

If the controllable component reverts back to stable operation within the partial load envelope, HVAC system 200 may release the override configuration, thereby enabling the controllable component to run in partial load mode again. In certain embodiments, the controllable component may be operating in a partial load mode near the boundary of its operating envelope, such that normal fluctuations may move the operation of the controllable component in and out of the operating envelope over short periods of time. Such fluctuations may cause the triggering and release of the override configuration by HVAC system 200 many times over a short span of time. As a result, the controllable component may switch between part load mode to full load mode unnecessarily, causing undesirable energy usage and potential damage to HVAC system 200.

In certain embodiments, HVAC system 200 is configured to handle this potential circumstance by determining that the component has resumed operating within its operating envelope for a pre-determined time period prior to resuming partial operation. The pre-determined time period may be substantially longer than the time period over which the fluctuations may occur. In some embodiments, the pre-determined time period is determined based on a timer that resets each time the HVAC system receives an indication that the component has exceeded its operating envelope. As an example, suppose the timer is set to 60 seconds. The timer begins counting down from 60 seconds to 59 seconds, 58 seconds, and so on. If the component exceeds its operating envelope during that time, the timer resets to 60 seconds and the process begins again. If the component does not exceed its operating envelope for a full 60 seconds, the timer expires. In response to expiry of the timer, the HVAC system 200 may be configured to release the override configuration such that HVAC system 200 resumes operating according to signals received from thermostat 240. As another example, bypass 210 may include a one-shot timer that only triggers the override configuration at a limited frequency to prevent unnecessary switching between modes.

In certain embodiments, the override configuration may not override all signals from thermostat 240 and/or controller 140. For example, HVAC system 200 may operate the component in the override configuration that only overrides signals that instruct the HVAC system 200 to operate in a partial load mode. In other words, HVAC system 200 may allow signals from thermostat 240 that instruct HVAC system 200 to operate the component in full load mode or off mode. In some embodiments, bypass 210 may only override the signal indicating the operational mode and not the on/off signal. In this manner, certain embodiments allow HVAC system 200 to only override the necessary signals that would cause the component to operate outside its envelope/in an unstable condition.

Components may have different operating characteristics over their lifespan. For example, normal wear and tear may change the operating envelopes of one or more components of HVAC system 200. As these change, the thresholds at which HVAC system 200 and/or bypass 210 may trigger the override condition may change. In certain embodiments, the threshold is determined based on a self-learning algorithm that adjusts the threshold based on monitoring performance of the component over time. For example, bypass 210 and/or controller 140 of HVAC system 200 may obtain long-term data indicating the normal operation of one or more components. Using this long-term data, HVAC system 200 may adjust one or more of the thresholds used to trigger the override configuration. In this manner, the thresholds may be adapted to ensure that the override configurations are only applied when necessary to prevent unstable operation.

The operating envelope may be determined a priori based on one more features of the controllable component. For example, in certain embodiments, the operating envelope of the component is determined based on the model of the component. Certain models may have different operating characteristics and stable operating spaces. In some embodiments, information identifying the model of the component, such as compressor 110, may be used by HVAC system 200 in controller 140 and/or bypass 210 to determine when to trigger the override configuration. In this manner, different operating envelopes may be considered without manual settings or long-term measurements.

In certain embodiments, sensors 220 may include one or more of a temperature sensor, a pressure sensor, a pair of temperature sensors, or a pair of pressure sensors. For example, sensors 220 may measure the temperature of a refrigerant flowing through compressor 100. A pair of sensors 220 may measure the condensing and evaporating temperature of the refrigerant, respectively, and may communicate that information to controller 140 and/or bypass 210. Similarly, sensors 220 may measure the pressure of a refrigerant and communicate that information to bypass 210 and/or controller 140. Bypass 210 may use the information measured at sensors 220 to determine whether a controllable component of HVAC system 200 is operating outside of its envelope.

In certain embodiments, sensors 220 may include one or more of a vibration sensor and a current sensor. For example, sensors 220 may measure one or more vibrational axes of a controllable component, such as compressor 110. As a specific example, sensors 220 may measure the vibration of a two-step scroll compressor, which exhibits high vibration when operating outside its operational envelope. In this manner, sensors 220 may measure conditions that may be used to determine whether the controllable component is operating outside its operational envelope. Similarly, current measurements by sensors 220 may also be used to indicate instabilities in the operational characteristics of a controllable component of HVAC system 200. In this manner, sensors 220 may provide the data with which bypass 210 may determine whether the controllable component of HVAC system 200, such as compressor 110, is operating outside its operational envelope.

In certain embodiments, sensors 220 may comprise one or more switches. Switches may control the operation of one or more components of HVAC system 200. For example, controller 140 and/or bypass 210 may receive an indication from the switch or switches whether one or more components of HVAC system 200 is in an on or off state.

In certain embodiments, the controllable component is compressor 110 and bypass 210 of HVAC system 200 may use one or more of the following to determine whether compressor 110 is operating outside its operating envelope: suction pressure, discharge pressure, pressure differential (e.g., difference between suction pressure and discharge pressure), suction temperature, discharge temperature, temperature differential (e.g., difference between suction temperature and discharge temperature), compressor force, compressor torque, compressor vibration, compressor current, or a combination of any of the preceding.

In certain embodiments, bypass 210 is further configured to compare a measurement from sensors 220 to a threshold. For example, there may be one or more pre-determined thresholds that represent the threshold separating stable and unstable operating conditions in a partial load mode. Using these thresholds, bypass 210 may trigger the override configuration to prevent the operation of the component in the unstable condition. Thresholds may represent one or more different parameters. For example, there may be a threshold temperature, temperature differential, pressure, pressure differential, current, vibration displacement, or any combination thereof.

HVAC system 200 may use separate signals for on/off signaling and mode signaling. For example, HVAC system 200 may use a first signal to indicate to compressor 110 to turn on and off and may use a second signal to indicate to compressor 110 to operate in a partial load mode or a full load mode. When operating the component in the override configuration, HVAC system 200 may only override the signal indicating the operational mode. For example, bypass circuit 210 may be configured to override the second signal to indicate to compressor 110 to operate in a partial load mode or full load mode and supply a replacement signal.

In certain embodiments, controller 140 may receive a signal from thermostat 240 indicating the need for environmental control of space 230. Based on this signal, controller 140 may generate the two signals for turning on or off and controlling the operational mode of one or more components. For example, based on the signal from thermostat 240, controller 140 may generate an on signal and a signal for operating compressor 110 in a partial load mode. In such circumstances, bypass 210 may override the second signal and supply a replacement signal, as described above if it determines that the component is operating outside its operating envelope, as described above.

Bypass 210 may be integrated into controller 140 or may be separate hardware coupled to controller 140 and/or the controllable component of HVAC system 200. Bypass 210 may include basic circuit elements, such as switches, relays, resistors, capacitors, inductors, etc. In some embodiments, bypass 210 may further include processing circuitry and memory separate from controller 140. While a simple example is provided below in reference to FIG. 4, it is contemplated in this disclosure that bypass 210 may include any suitable hardware and/or software/logic that would enable bypass 210 and/or HVAC system 200 to carry out the functions described herein.

Figure 3:
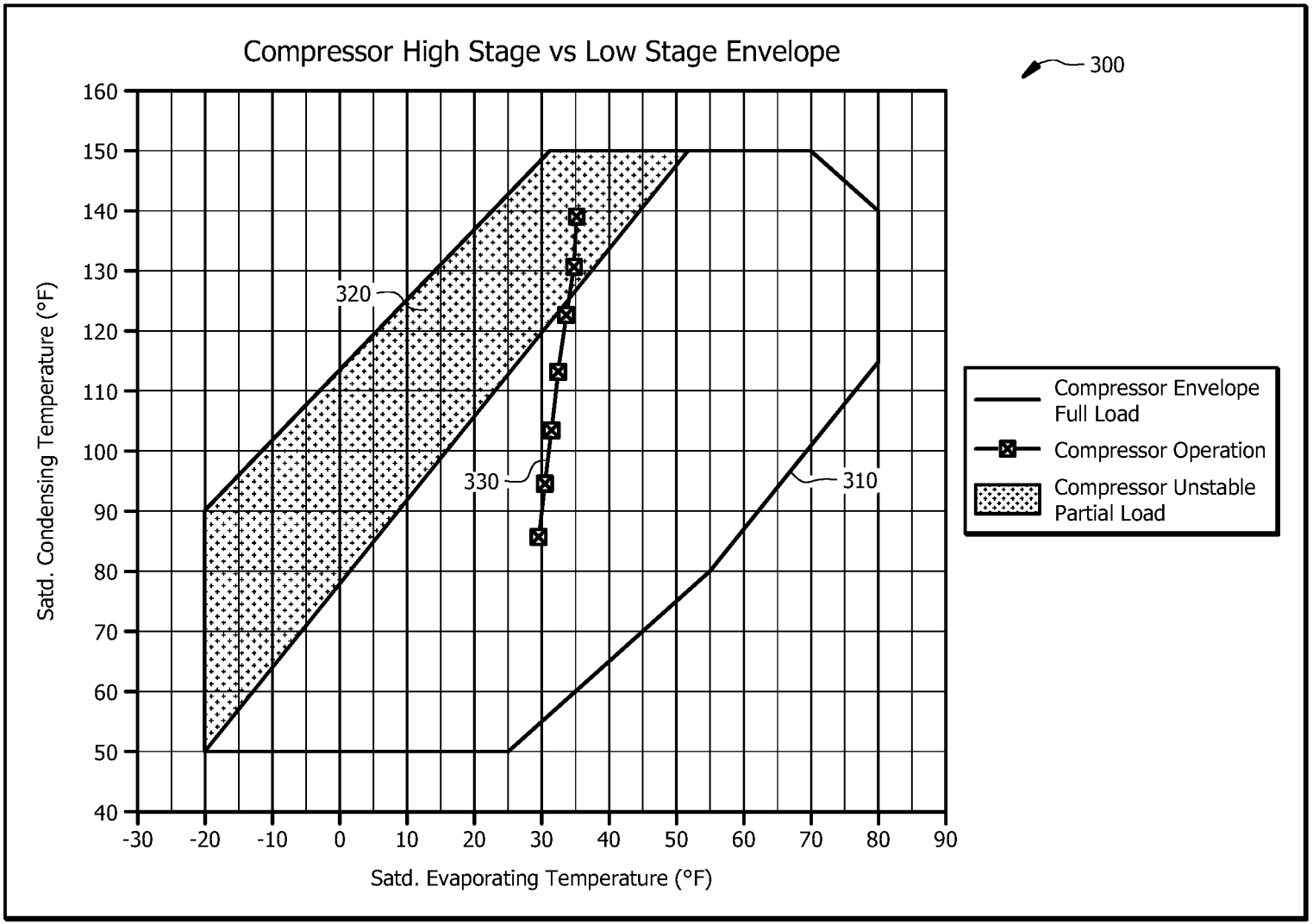
FIG. 3 is an example plot of compressor operating conditions and operating envelopes for full load and partial load operation, according to certain embodiments.

FIG. 3 is an example plot 300 of compressor operating conditions and operating envelopes for full load and partial load operation, according to certain embodiments. Plot 300 illustrates full load envelope 310, which may represent the stable operating space of a controllable component, such as compressor 110 or other components of HVAC system 200. As depicted in this example plot 300, full load envelope 310 may be represented as a bounded area with boundaries based on condensing and evaporating temperatures. Accordingly, in this example, knowing both the condensing and evaporating temperatures may determine whether compressor 110 is operating within full load envelope 310.

Plot 300 also includes unstable partial load envelope 320, which may represent the operating space in which the controllable component, such as compressor 110, would be unstable if operating in that space at a partial load operating state. Conversely, partial load envelope 320 may be considered as the non-overlapping operational space of the partial load mode and the full load mode of a component.

Plot 300 also illustrates an example operational plot 330 of an example compressor. Operational plot 330 illustrates an example curve of the evaporating and condensing temperatures of an example compressor, such as compressor 110. As illustrated, operational plot 330 extends within partial load envelope 320. In this operational state, the compressor may be unstable. In such cases, certain embodiments described above may trigger an override configuration that operates the compressor in full load mode. Thus, the compressor may safely operate in the entirety of full load envelope 310 stably.

Figure 4:
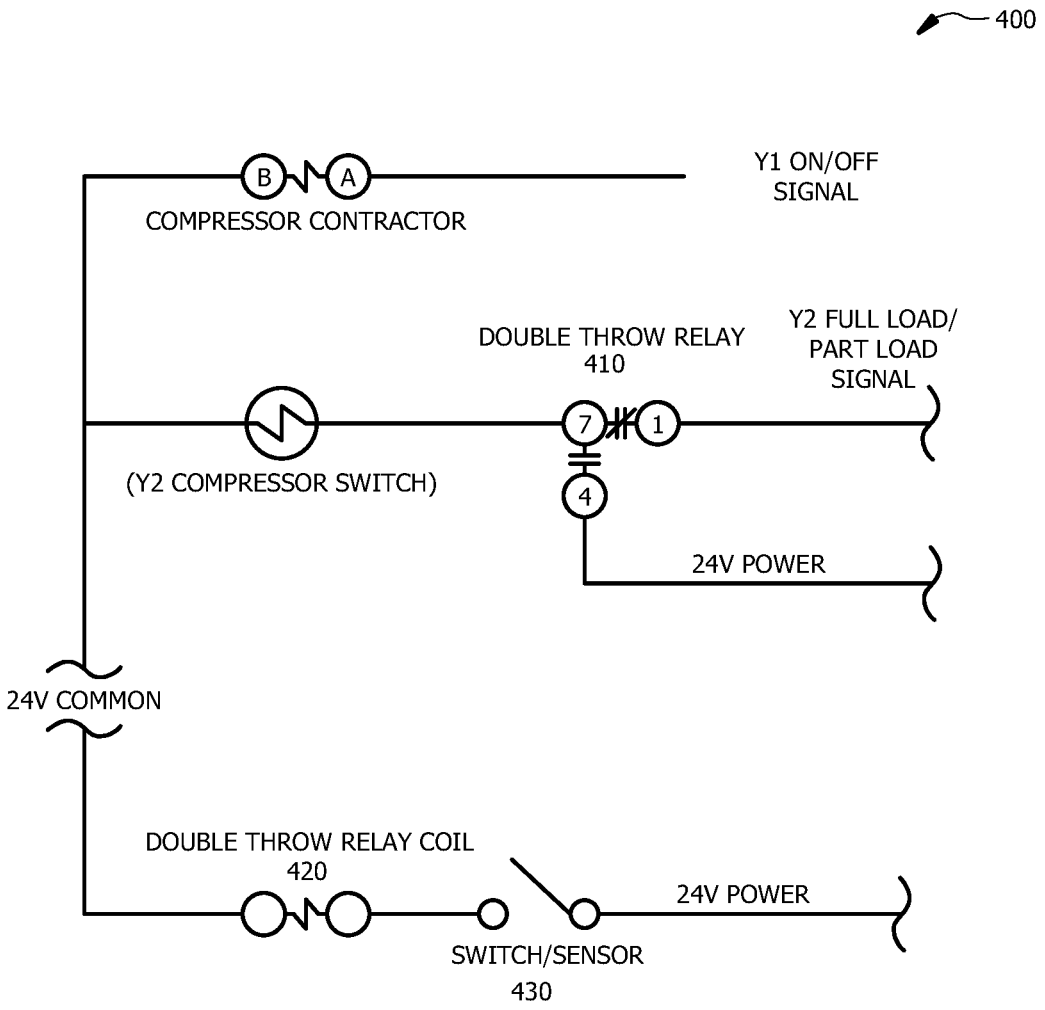
FIG. 4 illustrates an example bypass circuit, according to certain embodiments.

FIG. 4 illustrates an example bypass circuit, according to certain embodiments. This simplified circuit diagram of an example bypass circuit illustrates a simple embodiment of bypass 210 within HVAC system 200. In this example, compressor 110 may receive two signals from controller 140, the Y1 and the Y2. Y1 signal may operate the compressor contractor to turn compressor 110 on and off. The Y2 signal may indicate the operational mode of compressor 110. In certain embodiments, a thermostat may supply both the Y1 and Y2 signals. The Y1 signal may precede the Y2 signal and the Y1 signal may be coupled to the Y2 signal from the thermostat.

Bypass 210 may include double throw relay 410, double throw relay coil 420, and switch/sensor 430. Double throw relay 410 may include one or more connections, such as the connections between point 7 and 1 and between point 7 and 4. As depicted, the connection between point 7 and 1 is normally closed, as indicated by the not equal sign, and the connection between point 7 and 4 is normally open, indicated by the equals sign. Double throw relay 410 may lack a connection between one or more points, such as between points 1 and 4.

In certain embodiments, when compressor 110 is operating at partial load mode, the Y2 signal may be off. Bypass 210 may override the off Y2 signal by supplying an on signal on the Y2 line to the Y2 compressor switch by triggering double throw relay 410, double throw relay coil 420, and switch/sensor 430. Bypass 210 may override the Y2 signal after determining that compressor 110 is operating outside its partial load envelope. As an example, switch/sensor 430 may detect a determined threshold condition and trigger the passage of the "always on" 24V power signal through double throw relay 410. When switch/sensor 430 allows the 24V power to be applied to double throw relay coil 420, the normally open pole 7 to 4 of double throw relay 210 closes and the normally closed pole 7 to 1 will open. This will override any Y2 signals from the thermostat that will signal compressor 110 to operate high or low. The 24V Power signal provided by the thermostat is "always on". The 24V signal going through 4 to 7 will replace the Y2 signal from the thermostat and force the compressor to only operate in the full load configuration. In some embodiments, bypass 210 does not override the on/off signal. For example, bypass may not override the Y1 signal, which may allow compressor 110 to still be switched on and off by controller 140 and/or thermostat 240.

Figure 5:
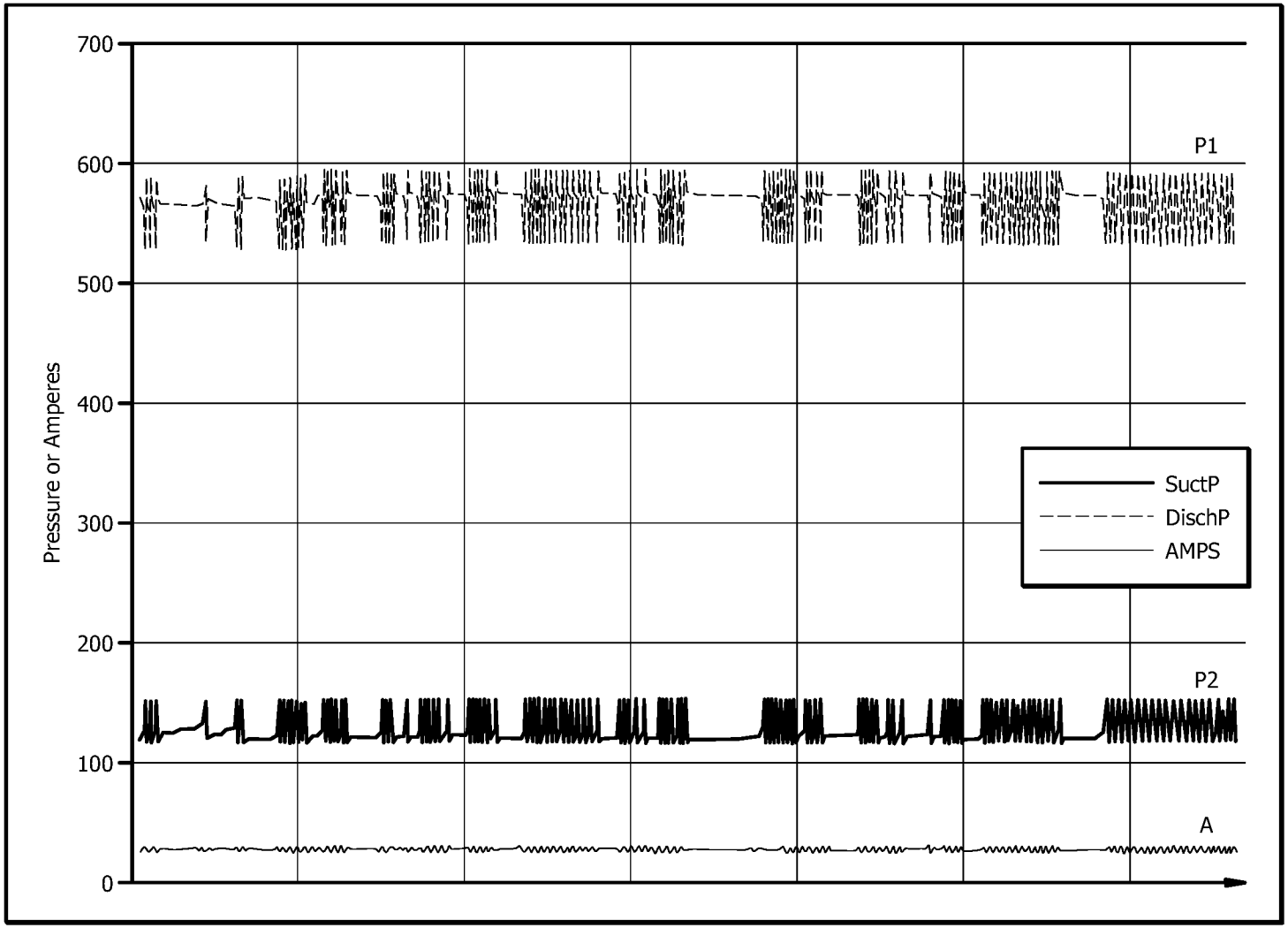
FIG. 5 is an example plot of suction and discharge pressures and current at an example compressor during unstable partial load operation, according to certain embodiments.

FIG. 5 is an example plot of pressures at an example compressor and current at the example compressor during unstable partial load operation. The plot illustrates three parameters measured at a compressor, such as compressor 110, over a period of time. For example, this plot illustrates the suction pressure SuctP, discharge pressure DischP, and current through the compressor AMPS. In nominal conditions, these plots may be substantially horizontal or straight. In the conditions during which these measurements were made, the compressor was operating in an unstable condition, as shown in the spikey or peaky plots of each of the parameters. Measurements of these parameters may be taken at one or more of sensors 220. Bypass 210 and/or HVAC system 200 may receive those measurements and use them to determine whether compressor 110 is operating in an unstable condition, e.g., outside its operating envelope. One or more of these parameters may be optimized for determining the operational stability of compressor 110. For example, the pressures may be more easily measured but may exhibit larger fluctuations during normal operation. On the other hand, current may be harder to measure accurately, but only small deviations are sufficient to determine that an override configuration is needed.

Figure 6:
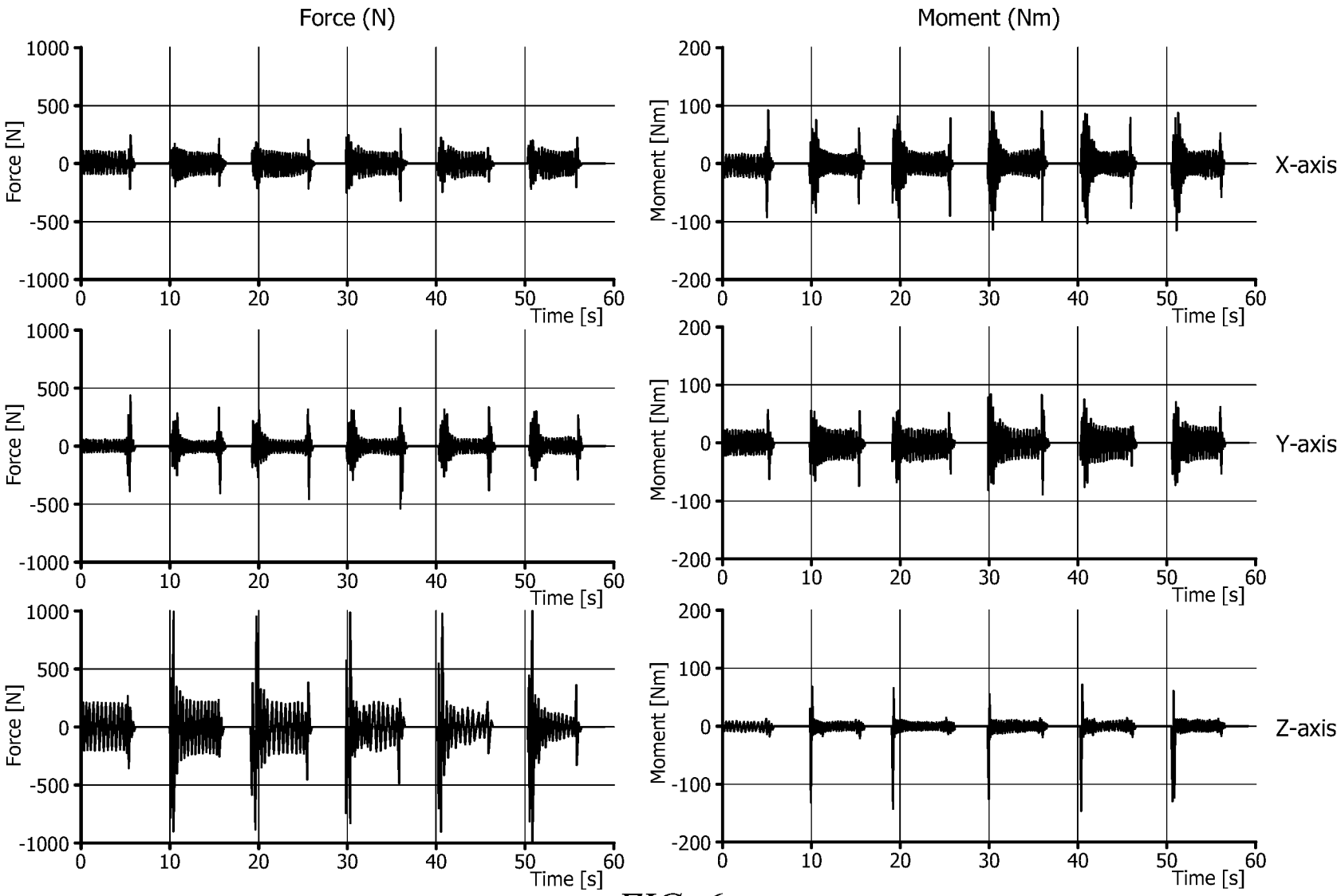
FIG. 6 is an example plot of forces and moments at various axes of an example compressor during unstable partial load operation, according to certain embodiments.

FIG. 6 is an example plot of forces and moments at various axes of an example compressor during unstable partial load operation, according to certain embodiments. Similar to the plots in FIG. 5, these parameters, Force (N) and Moment (Nm) during nominal operation are substantially constant. During unstable operation, however, these parameters may vary significantly over time. For a two-step scroll compressor, unstable operation may be indicated by unstable forces and torques on the housing of the compressor. These forces and moments may not be evenly applied at the various axes. For example, as shown in FIG. 6, some axes exhibit larger deviations from the average during unstable operation. In this manner, HVAC system 200 may use only a subset of measurements from specific axes to determine whether an override configuration is necessary. Various components of HVAC system 200 may have different indications of unstable operation. Accordingly, HVAC system 200 may have different sensors 220 or may receive different information regarding the operational characteristics of different components. In this manner, HVAC system 200 and bypass 210 may more accurately trigger the override condition and supply a replacement signal to prevent unstable operation of various components.

While controller 140, thermostat 240, and bypass 210 are described above as separate controlling apparatuses, one or more of controller 140, thermostat 240, and bypass 210 may be integrated or separated into one or more hardware and/or software modules. Further, controller 140 may be communicatively coupled to thermostat 240 and/or bypass 210. Additionally, controller 140 may be coupled to multiple thermostats 240 at one or more spaces 230. In some embodiments, HVAC system 200 includes multiple loads 130 for multiple spaces 230 across a building or other larger space. In this manner, the embodiments disclosed herein may be applied to more distributed and larger systems even though the simpler configuration is used as an example.

This disclosure contemplates each of controller 140, thermostat 240, and bypass 210, including any combination of hardware (e.g., a processor and a memory). A processor of controller 140, thermostat 240, or bypass 210, may be any electronic circuitry, including, but not limited to microprocessors, application specific integrated circuits (ASIC), application specific instruction set processor (ASIP), and/or state machines, that communicatively couples to a memory of controller 325 and controls the operation of the climate control system. The processor may be 8-bit, 16-bit, 32-bit, 64-bit or of any other suitable architecture. The processor may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The processor may include other hardware and software that operates to control and process information. The processor executes software stored on memory to perform any of the functions described herein. The processor controls the operation and administration of the cooling system by processing information. The processor may be a programmable logic device, a microcontroller, a microprocessor, any suitable processing device, or any suitable combination of the preceding. The processor is not limited to a single processing device and may encompass multiple processing devices.

The memory may store, either permanently or temporarily, data, operational software, or other information for the processor. The memory may include any one or a combination of volatile or non-volatile local or remote devices suitable for storing information. For example, the memory may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory, a disk, a CD, or a flash drive. In particular embodiments, the software may include an application executable by the processor to perform one or more of the functions described herein.

Figure 7:
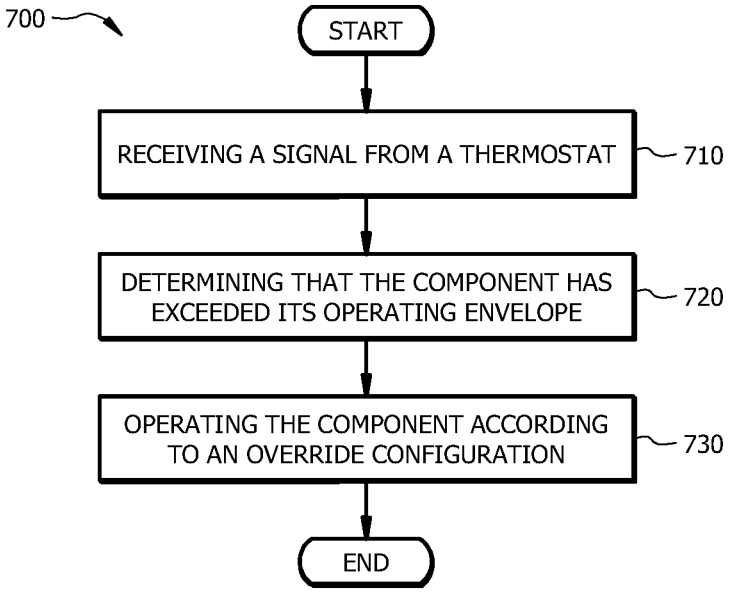
FIG. 7 is a flowchart illustrating a method of operating an HVAC system, such as the example system of FIG. 2.

FIG. 7 is a flowchart illustrating a method 700 of operating system 200 of FIG. 2. In particular embodiments, various components of system 200 perform the steps and method 700. Method 700 may begin at step 710, wherein a signal from a thermostat, such as thermostat 240, is received. The signal instructs HVAC system 200 to operate a component in a partial load mode. In some embodiments, the component is compressor 110.

At step 720, it may be determined that the component has exceeded its operating envelope. For example, HVAC system 200 may receive an indication that compressor 110 is operating or may soon operate outside its partial load mode operating envelope. The indication may be based on one more sensors 220 coupled to HVAC system 200.

After determining that the component has exceeded its operating envelope, method 700 may move to step 730, where the component is operated according to an override configuration. The override configuration overrides the signal to operate the component in the partial load mode. For example, bypass 210 of HVAC system 200 may block the signal from thermostat 240 that signals to compressor 110 to operate in a partial load mode and may then supply a replacement signal to compressor 110 that signals compressor 110 to operate in a full load mode. As a result, the operation mode of the component may be overridden to prevent the component from operating outside its operating envelope.

Modifications, additions, or omissions may be made to method 700 depicted in FIG. 7. Method 700 may include more, fewer, or other steps. For example, method 700 may further include the optional step of determining a present setpoint of the thermostat. Method 700 may further include operating the component in a full load mode until the present setpoint is reached and turning off the component for a period of time once the present setpoint has been reached. In this manner, the overriding of the signal does not prevent that satisfaction of the setpoint. As another example, method 700 may further include the step of determining that the component has resumed operating within its operating envelope for a pre-determined time period. In response, the override configuration may be released such that HVAC system 200 resumes operating according to signals received from the thermostat. The pre-determined time period may be based on a timer that resets each time the HVAC system receives an indication that the component has exceeded its operating envelope.

Additionally, steps may be performed in parallel or in any suitable order. While discussed as various components of HVAC system 200 performing the steps, any suitable component or combination of components of HVAC system 200 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An HVAC system comprising:

a thermostat configured to:

transmit a signal intended for a component of the HVAC system, wherein the signal instructs the component to operate in a partial load mode; and a bypass circuit configured to:

intercept the signal instructing the component to operate in the partial load mode;

determine that the component has exceeded its operating envelope; and in response to determining that the component has exceeded its operating envelope, send a replacement signal to the component, wherein the replacement signal instructs the component to operate according to an override configuration, wherein the override configuration prevents operation of the component in the partial load mode for at least a period of time.

2. The HVAC system of claim 1, wherein to send a replacement signal instructing the component to operate according to the override configuration, the bypass circuit is further configured to:

determine a present setpoint of the thermostat; and wherein the replacement signal further instructs the component to:

operate in a full load mode until the present setpoint is reached; and turn off for a second period of time once the present setpoint has been reached.

3. The HVAC system of claim 1, the bypass circuit further operable to:

determine that the component has resumed operating within its operating envelope for a pre-determined time period and, in response, release the override configuration such that the component resumes operating according to signals received from the thermostat;

wherein the pre-determined time period is determined based on a timer that resets each time the bypass circuit receives an indication that the component has exceeded its operating envelope.

4. The HVAC system of claim 1, wherein when operating according to the override configuration, the bypass circuit is further operable to allow signals from the thermostat that instruct the component to operate in full load mode or off mode.

5. The HVAC system of claim 1, wherein the component corresponds to a compressor of the HVAC system and to determine that the compressor has exceeded its operating envelope, the bypass circuit is further configured to determine whether at least one of the following values has exceeded a threshold: suction pressure, discharge pressure, pressure differential, suction temperature, discharge temperature, temperature differential, compressor force, compressor torque, compressor vibration, compressor current, and a combination of any of the preceding.

6. The HVAC system of claim 5, wherein the threshold is determined based on a self-learning algorithm that adjusts the threshold based on monitoring performance of the component over time.

7. The HVAC system of claim 1, wherein the operating envelope of the component is determined based on a model of the component.

8. A method of operating an HVAC system, comprising:

intercepting a signal from a thermostat, wherein the signal instructs a component of the HVAC system to operate in a partial load mode;

determining that the component has exceeded its operating envelope; and in response to determining that the component has exceeded its operating envelope, sending a replacement signal to the component, wherein the replacement signal instructs the component to operate according to an override configuration, wherein the override configuration prevents operation of the component in the partial load mode for at least a period of time.

9. The method of claim 8, further comprising:

determining a present setpoint of the thermostat; and wherein the replacement signal further instructs the component to:

operate in a full load mode until the present setpoint is reached; and turn off for a second period of time once the present setpoint has been reached.

10. The method of claim 8, further comprising:

determining that the component has resumed operating within its operating envelope for a pre-determined time period and, in response, releasing the override configuration such that the component resumes operating according to signals received from the thermostat;

wherein the pre-determined time period is determined based on a timer that resets each time the HVAC system receives an indication that the component has exceeded its operating envelope.

11. The method of claim 8, wherein operating according to the override configuration comprises allowing signals from the thermostat that instruct the component to operate in full load mode or off mode.

12. The method of claim 8, wherein the component corresponds to a compressor of the HVAC system and to determine that the compressor has exceeded its operating envelope, the method further comprises determining whether at least one of the following values has exceeded a threshold: suction pressure, discharge pressure, pressure differential, suction temperature, discharge temperature, temperature differential, compressor force, compressor torque, compressor vibration, compressor current, and a combination of any of the preceding.

13. The method of claim 12, wherein the threshold is determined based on a self-learning algorithm that adjusts the threshold based on monitoring performance of the component over time.

14. The method of claim 8, wherein the operating envelope of the component is determined based on a model of the component.

15. A system comprising:

a compressor configured to receive a first signal and a second signal, the first signal indicating to the compressor to turn on or off and the second signal indicating to the compressor at which speed to operate, a controller configured to control the operation of the compressor, wherein the first and second signals originate from signals generated at the controller; and a bypass circuit configured to intercept the second signal originating from signals generated at the controller before the second signal is received by the compressor and supply a replacement second signal to the compressor.

16. The system of claim 15, wherein:

the second signal comprises a signal instructing the compressor to run in a partial load mode; and the replacement second signal comprises a signal instructing the compressor to run at a full load mode.

17. The system of claim 15, further comprising one or more sensors comprising one or more of a temperature sensor, a pressure sensor, a pair of temperature sensors, and a pair of pressure sensors, wherein the bypass circuit is configured to intercept the second signal and supply the replacement second signal based on measurements at the one or more sensors.

18. The system of claim 15, further comprising one or more sensors comprising one or more of a vibration sensor and a current sensor, wherein the bypass circuit is configured to intercept the second signal and supply the replacement second signal based on measurements at the one or more sensors.

19. The system of claim 17, wherein the bypass circuit is further configured to:

compare a measurement from one or more sensors to a threshold; and determine whether to intercept the second signal and supply a replacement second signal based on the comparison of the measurement to the threshold.

20. The system of claim 15, wherein the bypass circuit is configured to intercept the second signal and supply the replacement second signal to the compressor for a predetermined period of time.

* * * * *